United States Patent [19]

Harada et al.

[11] 3,993,475

[45] Nov. 23, 1976

[54] HEAT RESISTING ALLOYS

[75] Inventors: Kohsaburo Harada, Tokyo; Yousuke Matsumoto; Rokurou Kiyoshima, both of Kanagawa, all of Japan

[73] Assignee: Duraloy Blaw-Knox, Inc., Scottdale, Pa.

[22] Filed: Apr. 18, 1975

[21] Appl. No.: 569,499

[30] Foreign Application Priority Data

Apr. 20, 1974 Japan ..... 49-43906

[52] U.S. Cl. ..... 75/134 F

[51] Int. Cl.[2] ..... C22C 30/00

[58] Field of Search ..... 75/122, 134 F

[56] References Cited

UNITED STATES PATENTS

| | | | |
|---|---|---|---|
| 2,481,976 | 9/1949 | Cape | 75/134 F |
| 2,504,453 | 4/1950 | Rotherham et al. | 75/134 F |
| 2,860,968 | 11/1958 | Boegehold et al. | 75/122 |
| 3,366,473 | 1/1968 | Nehrenberg et al. | 75/122 |

*Primary Examiner*—W. Stallard

*Attorney, Agent, or Firm*—Buell, Blenko & Ziesenheim

[57] ABSTRACT

A new alloy is provided having high creep strength at elevated temperatures in the range 1100° to 1200° C. and which is unusually resistant to corrosion and thermal shock and has unusual stress rupture characteristics at the elevated temperatures here involved consisting essentially of, by weight, about 0.3% to 0.9% carbon, 20% to 30% chromium, 26% to 40% nickel, 0.8% to 4.0% manganese, 0.9% to 3.5% silicon, 0.3% to 5.0% tungsten, 3.5% to 8.5% cobalt and the balance iron with residual impurities in ordinary amounts.

6 Claims, 1 Drawing Figure

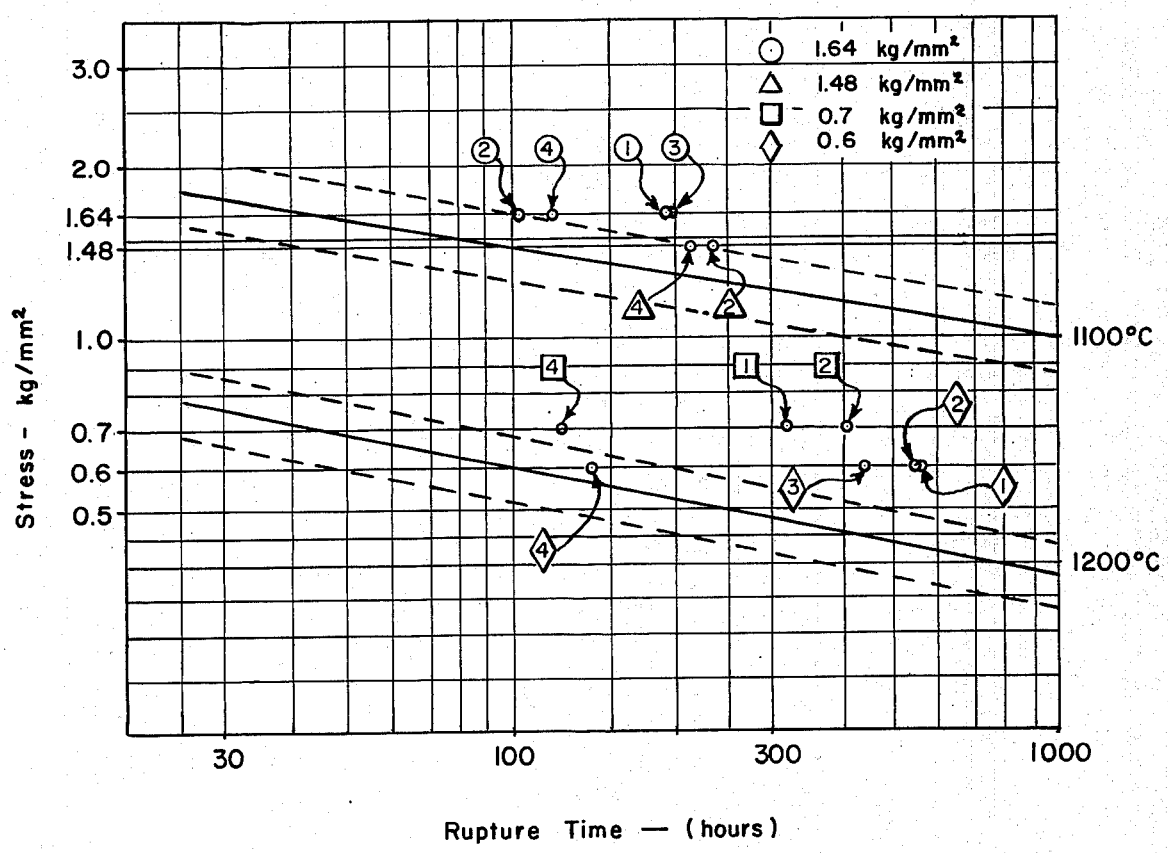
1.64 kg/mm²
1.48 kg/mm²
0.7 kg/mm²
0.6 kg/mm²
3.0
2.0
1.64
1.48
1.0
0.7
0.6
0.5
Stress - kg/mm²
1100°C
1200°C
30
100
300
1000
Rupture Time — (hours)

HEAT RESISTING ALLOYS

This invention relates to heat resisting alloys and particularly to heat resistant alloys characterized by low creep and high strength at elevated temperatures in the range 1100° to 1200° C.

We have developed an alloy which is an improvement on those alloys sold by Blaw-Knox Company under the trademark Mo Re No. 1 for high temperature and high stress applications. The composition of Mo Re No. 1 is basically C 0.3–0.9%, Cr 20–30%, Ni 15–35%, Mn 0.8–4.0%, Si 0.9–3.5%, W 0.3–4.0% and the balance Fe.

We have found that we can obtain not only higher creep strength at temperatures in the range 1100° to 1200° C. than the prior art compositions but we can also maintain equally good oxidation resistant properties at such high temperatures.

The broad composition range of this invention lies within the limits:

| | |
|---|---|
| Carbon | 0.3% – 0.9% by weight |
| Chromium | 20% – 30% by weight |
| Nickel | 26% – 40% by weight |
| Manganese | 0.8% – 4.0% by weight |
| Silicon | 0.9% – 3.5% by weight |
| Tungsten | 0.3% – 5.0% by weight |
| Cobalt | 3.5% – 8.5% by weight |
| Iron | Balance with residual impurities in ordinary amounts |

We have found that, while the above alloy is a marked improvement over the prior art in creep strength at elevated temperatures, the alloy can be still further improved in creep strength at high temperatures by the addition of 0.3% to 2.5% by weight niobium. The addition of niobium appears to stabilize precipitated carbides thereby improving the creep resistance.

The various components of the alloy are critical in their relationship to one another in developing creep strength.

Carbon contents outside the range 0.3% to 0.9% prevent the alloy from attaining the required creep strength. Chromium in amounts less that 20% result in a marked drop in resistance to oxidation at high temperatures while increases in chromium 30% in the alloy cause a lowering of creep strength at high temperatures.

Nickel content must need be 26% or more to keep the stability of the austenite. On the other hand, more than 40% will bring about merely a cost increase and no appreciable effect worth the increase. It is uneconomical.

Manganese and silicon contents respectively not less than 0.8% and 0.9% will not only work as deoxidizers but promote the fluidity of molten metal. However, each content in excess of 4% and 3.5% as the upper limit will cause the alloy to lose necessary creep strength.

Tungsten content less that 0.3% will make the alloy fail to attain required high creep strength, however tungsten in excess of 5.0% will spoil the structural stability and ductility.

Cobalt is the component not contained in the conventional heat resisting alloy as aforementioned. The inventors of this invention discovered, however, that 3.5% or more of cobalt addition will increase creep strength at high temperatures, that less than 3.5% of it will be of no avail, and that because cobalt is more expensive than nickel, the addition of cobalt in excess of 8.5% will merely boost up the cost without corresponding advantage though there is no harm otherwise.

It is, of course, generally known that some of the conventional heat resisting alloys contain cobalt but they do not attain the required high creep strength and the cost is too high due to an improper nickel content or too much cobalt content, along with a failure to properly control the other ingredients of the composition within the critical limits here claimed. Such alloys accordingly lack the control of creep strength as compared with the alloy of this invention.

The significance and value of this invention can perhaps be best understood by examples of the alloy of the invention compared with prior art alloys. Examples of the study of the high temperature characteristics of the alloy of this invention in comparison with conventional heat resisting alloys and conventional low creep alloys are shown below.

A series of comparison alloys were melted and the compositions are set out in Table I.

TABLE I

| Component Sample No. | C | Si | Mn | Ni | Cr | W | S | Co | Nb | Fe |
|---|---|---|---|---|---|---|---|---|---|---|
| 1 | 0.33 | 1.19 | 0.85 | 28.6 | 25.8 | 0.76 | 0.003 | 6.73 | — | Balance |
| 2 | 0.41 | 1.05 | 0.88 | 31.9 | 25.6 | 2.49 | 0.005 | 6.56 | — | " |
| 3 | 0.47 | 1.07 | 1.17 | 27.8 | 26.0 | 2.28 | 0.007 | 8.18 | 0.60 | " |
| 4 | 0.36 | 1.11 | 0.62 | 20.6 | 25.5 | 1.58 | 0.004 | 13.9 | — | " |

Specimens 1 to 3 of Table I are the alloy examples of this invention. Specimen 4 is a conventional heat resisting alloy outside the scope of the alloy composition of this invention, namely deviating in the amount of manganese, nickel and cobalt and corresponding generally to Mo Re No. 1

EXAMPLE I

Rupture time of each specimen in Table I was measured when loaded with the stress respectively of 1.64 kg/mm² and 1.48 kg/mm² at 1,100° C. and also with the stress respectively of 0.7 kg/mm² and 0.6 kg/mm² at 1,200° C. The result is shown in Table II.

TABLE II

| Sample No. | 1,100° C. | | 1,200° C. | |
|---|---|---|---|---|
| | 1.64 kg/mm² | 1.48 kg/mm² | 0.7 kg/mm² | 0.6 kg/mm² |
| 1 | 193.0 | — | 309.7 | 548.1 |
| 2 | 102.0 | 229.0 | 400.9 | 543.8 |
| 3 | 195.7 | — | — | 428.8 |
| 4 | 112.0 | 209.0 | 123.4 | 137.0 |

The accompanying drawing, in the form of a graph shows the rupture time (hours) of samples 1 to 4 of Table II, wherein rupture time (hour) is in the axis of abscissa and stress (kg/mm²) is in the axis of ordinate. The full lines a and b indicate the relation between stress and rupture time (hour) at 1,100° C. and 1,200° C. of another of the conventional heat resisting alloys (Mo Re No. 1 hereafter identified as $M_1$) within the scope of composition as stated before to compare with these samples. The width of the dotted lines at both sides of the full lines a and b indicates the width or range of the accumulated data for the heat resisting alloy $M_1$. As the result is seen clearly in the graph, all of the samples 1 to 4 at 1,100° C. stayed within the upper limit or a little above it of the zone indicated by the dotted line of the range for conventional heat resisting alloy $M_1$.

Of the samples 1 to 4 at 1,200° C., the alloys of this invention from 1 to 3 went beyond the upper limit of the zone of the conventional heat resisting alloy $M_1$ while sample 4 stayed within the limit of $M_1$ zone.

That is, each of the samples 1 to 4 can get as good a creep rupture strength as $M_1$ or even a little better at 1,100° C. for a short time use up to around 1,000 hours, but the samples 1 to 3 at 1,200° C. can get a higher creep rupture strength than that of sample 4 and the conventional heat resisting alloy $M_1$. From this it is considered possible to retain a higher creep rupture strength than that of Sample 4 and the conventional heat resisting alloy $M_1$ even at a temperature in the vicinity of 1,100° C. for the considerable long time use (more than 1,000 hours).

EXAMPLE II

High temperature oxidation tests were made on the samples in Table I and the conventional heat resisting alloy $M_1$, wherein the loss of weight by oxidation was measured. The test practices followed were:

| | |
|---|---|
| Test condition: | Heating at 1,200° C. in the atmosphere for 300 hours |
| Size of Specimens: | 20.0 m/m $\phi$, 6 m/m t |
| Treatment of Weighing: | Boil in the aqueous solution of 18% NaOH and 3% $KMnO_4$ and then boil in the aqueous solution of 10% ammonium citrate |

All the samples displayed good oxidation resistance at high temperatures as shown in Table III.

TABLE III

| Sample No. | Loss of Weight by Oxidation (mg/cm³) |
|---|---|
| 1 | 25.1 |
| 2 | 22.0 |
| 3 | 43.8 |
| 4 | 36.8 |
| $M_1$ | 31.1 |

As explained in the above and shown by these tests this invention will provide a heat resisting alloy characterized by high creep strength far superior to the conventional heat resisting alloys at a high temperature between 1,100° C. and 1,200° C. and also good oxidation resistance at said high temperature at the same time.

While we have described certain preferred embodiments of our invention in the foregoing specification, it will be understood that this invention may be otherwise embodied within the scope of the following claims.

We claim:

1. An alloy characterized by high creep strength at elevated temperatures in the range 1,100° C. to 1,200° C., by resistance to corrosion, particularly in the form of oxidation, by resistance to thermal shock and by unusual stress rupture characteristics at elevated temperatures consisting of, by weight, about 0.3% to 0.9% carbon, about 20% to 30% chromium, about 26% to 40% nickel, about 0.8% to 4.0% manganese, about 0.9% to 3.5% silicon, about 0.3% to 5.0% tungsten, about 3.5% to 8.5% cobalt and the balance iron with residual impurities in ordinary amounts.

2. An alloy as claimed in claim 1 having 0.3% to 2.5% by weight niobium.

3. An alloy article for use at elevated temperatures in the range 1,100° to 1,200° C. made from an alloy characterized by high creep strength at elevated temperatures in the range 1,100° to 1,200° C., by resistance to corrosion, particularly in the form of oxidation, by resistance to thermal shock and by unusual stress rupture characteristics at elevated temperatures consisting of, by weight, about 0.3% to 0.9% carbon, about 20% to 30% chromium, about 26% to 40% nickel, about 0.8% to 4.0% manganese, about 0.9% to 3.5% silicon, about 0.3% to 5.0% tungsten, about 3.5% to 8.5% cobalt and the balance iron with residual impurities in ordinary amounts.

4. An alloy article as claimed in claim 3 containing 0.3% to 2.5% by weight niobium.

5. A structural member for use at elevated temperature in the range 1,100° to 1,200° C. made from an alloy characterized by high creep strength at elevated temperatures in the range 1,100° to 1,200° C., by resistance to corrosion, particularly in the form of oxidation, by resistance to thermal shock and by unusual stress rupture characteristics at elevated temperatures consisting of, by weight, about 0.3% to 0.9% carbon, about 20% to 30% chromium, about 26% to 40% nickel, about 0.8% to 4.0% manganese, about 0.9% to 3.5% silicon, about 0.3% to 5.0% tungsten, about 3.5% to 8.5% cobalt and the balance iron with residual impurities in ordinary amounts.

6. A structural member as claimed in claim 5 containing 0.3% to 2.5% by weight niobium.

* * * * *

UNITED STATES PATENT OFFICE

CERTIFICATE OF CORRECTION

PATENT NO. : 3,993,475

DATED : November 23, 1976

INVENTOR(S) : KOHSABURO HARADA et al.

It is certified that error appears in the above-identified patent and that said Letters Patent are hereby corrected as shown below:

Column 1, line 55, after "chromium" should read --above--.

Column 4, Claim 5, lines 39 and 40, "temperature" should read --temperatures--.

Signed and Sealed this

Fifteenth Day of February 1977

[SEAL]

*Attest:*

RUTH C. MASON
*Attesting Officer*

C. MARSHALL DANN
*Commissioner of Patents and Trademarks*